US006236361B1

(12) United States Patent
Rosen

(10) Patent No.: US 6,236,361 B1
(45) Date of Patent: May 22, 2001

(54) PRECISION BEACON TRACKING SYSTEM

(75) Inventor: Harold A. Rosen, Santa Monica, CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/301,966

(22) Filed: Apr. 29, 1999

(51) Int. Cl.[7] ..... H01Q 3/00
(52) U.S. Cl. ..... 342/359; 342/352; 342/427
(58) Field of Search ..... 342/74, 92, 359, 342/427, 352

(56) References Cited

U.S. PATENT DOCUMENTS 3,718,927 * 2/1973 Howard et al. ..... 343/7.4
3,836,972 * 9/1974 Conway et al. ..... 343/100 ME
3,893,116 * 7/1975 Hudspeth et al. ..... 343/16 M
3,931,623 * 1/1976 Sones et al. ..... 343/225
4,418,350 * 11/1983 Rosen ..... 343/359
4,806,932 * 2/1989 Bechtel ..... 342/33
5,128,682 * 7/1992 Kruger et al. ..... 342/153

* cited by examiner

*Primary Examiner*—Dao Phan

(57) ABSTRACT

A system and method for eliminating pointing error in a beacon tracking system due to uncontrolled differences in passive loss or in amplification of the separate signals involved in creating a pilot signal. A locally generated reference signal (30) is radiated onto a set of feed horns (14), at least three (20, 22, 24) of which are used to track a pilot signal (18). The reference signal (30) is detected and used in an automatic gain control feedback loop (44, 46, 48) to maintain equal gain on the separate feed horn channels. The equalized signal is processed (62) to produce precision tracking signals.

18 Claims, 2 Drawing Sheets

PRECISION BEACON TRACKING SYSTEM

TECHNICAL FIELD

The present invention relates to antenna control systems and, more particularly, the present invention relates to precise pointing and control of the directional antennas of communications satellites.

BACKGROUND ART

To obtain optimum communication coverage over an area being served by a communications satellite, precise directional satellite antenna control is necessary. Antenna control systems are described in U.S. Pat. Nos. 3,757,336 and 4,418,350.

U.S. Pat. No. 3,757,336 describes a satellite antenna control system that uses a pilot signal, or beacon, transmitted from an earth station to the satellite where it is received, processed, decoded and utilized to control the satellite for tracking and offset.

As a consequence of the higher frequencies employed, narrower antenna beams are being used in communication satellite service. Therefore, much more precise antenna beam pointing accuracies are required. U.S. Pat. No. 4,418,350 describes an antenna control system in which a communications satellite directional antenna can be aimed and controlled. The system makes use of a ground based beacon station that transmits an uplink signal to the satellite, including frequency differentiated communication signals and the beacon signal.

The communications signals and the beacon signal are received by a common directional antenna on the satellite. A microwave network, coupled to a multiple feed horn assembly of the antenna and responsive to the beacon, produces signal components including a sum signal and east-west and north-south error signals. The error signals are indicative of the corresponding angular errors between the desired antenna pointing direction and the direction from the satellite to the beacon station. Subsequent processing of the signal components in a command and control receiver yields steering signals for controlling the antenna pointing direction with respect to the beacon station.

In the communication systems described above, the beacon is transmitted to a reflector on the satellite. The reflector is illuminated by a set of receiving horns arranged in a predetermined manner in the focal plane of the reflector. The positioning and relative phasing of the wave energy applied to the set of feed horns provides the antenna beam coverage desired.

Each of the receive horns is separately amplified and down converted to an intermediate frequency. Because each horn has a separate amplifier, the expected difference in gain on the three channels is a source for pointing errors. Pointing errors introduce interference from nearby beams that could potentially disrupt the communications satellite service.

SUMMARY OF THE INVENTION

In the present invention, a reference signal generated on the satellite is used to equalize the gain of the separate channel amplifiers used in processing the beacon signal to generate an error signal. The reference signal is radiated from a small antenna located in the center of the reflector. The reference signal, by virtue of its wide beam width, strikes each one of a plurality of horns that surround the beacon source with the same power.

It is an object of the present invention to eliminate the error caused by gain variations in separate amplifiers in an antenna pointing control system. It is another object of the present invention to accomplish this by equalizing the gain of the amplifiers used in amplifying the beacon.

It is a further object of the present invention to locally generate a reference signal and to radiate the reference signal from an antenna strategically placed at the center of the reflector, or focusing lens, located on the satellite.

Other objects and features of the present invention will become apparent when viewed in light of the detailed description of the preferred embodiment when taken in conjunction with the attached drawings and appended claims.

BEST MODE(S) FOR CARRYING OUT THE INVENTION

Figure 1A:
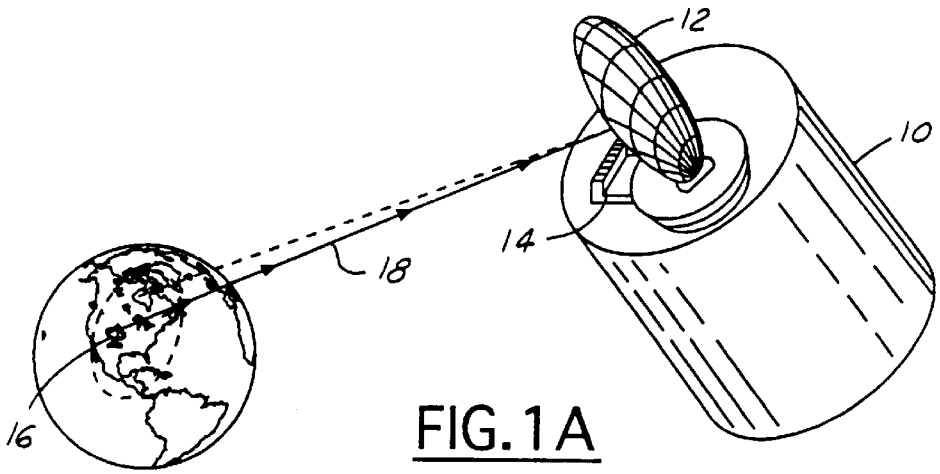
FIG. 1A is an illustration of a satellite providing communications to and from a beacon station located in a predetermined area on earth, a parabolic reflector is shown.
Figure 1B:
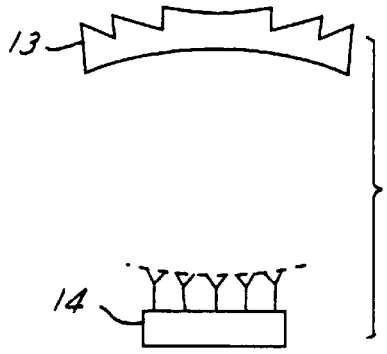
FIG. 1B is an illustration of a focusing lens.

A communications satellite 10 having a parabolic reflector 12 and a set of antenna feed horns 14 is shown in FIG. 1A. The present invention would work equally as well with any suitable focusing device such as a lens as shown in FIG. 1B. In FIG. 1A a beacon station 16 is located at a predetermined point on the earth. The positioning and relative phasing of the wave energy applied to the set of feed horns 14 provides the antenna beam coverage desired. A beacon signal 18 is radiated from the beacon station 16 and focused on the set of antenna feed horns 14.

Figure 2:
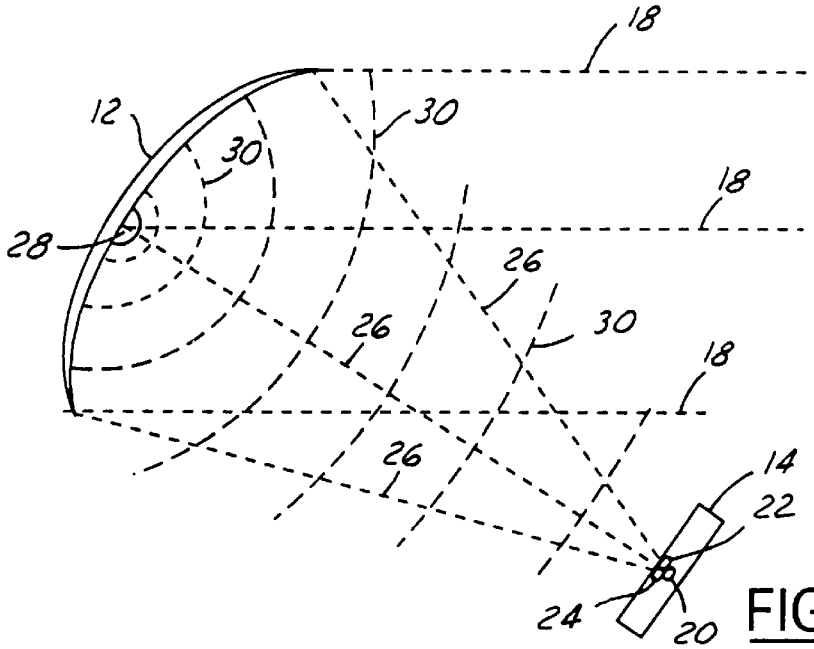
FIG. 2 is a view of the satellite reflector, the arrangement of the receiving horns, and the reference signal radiator.

Referring now to FIG. 2, there is shown, in more detail, the reflector 12 and the set of antenna feed horns 14. At least three horns, 20, 22 and 24, in the set of horns 14 are used to receive the beacon signal 18 from the beacon station 16 and to derive an error signal 26 for aiming the satellite 10. Three horns are used in the case of a triangular array as shown in FIG. 2. However, it is also possible to utilize other horn configurations in the present invention. For example, four horns may be used in the case of a square or rectangular array (not shown). In any event, the common intersection of the horns 20, 22, 24 is disposed so that it coincides with the predetermined spot in the focal plane of the reflector 12 that corresponds closely to the image position of the beacon station.

A small antenna 28 centrally located on the reflector 12 radiates an internally generated reference signal 30 to the set of horns 14. The reference signal 30 has a broad beam and therefore strikes the set of horns 14 with equal power.

Figure 3:
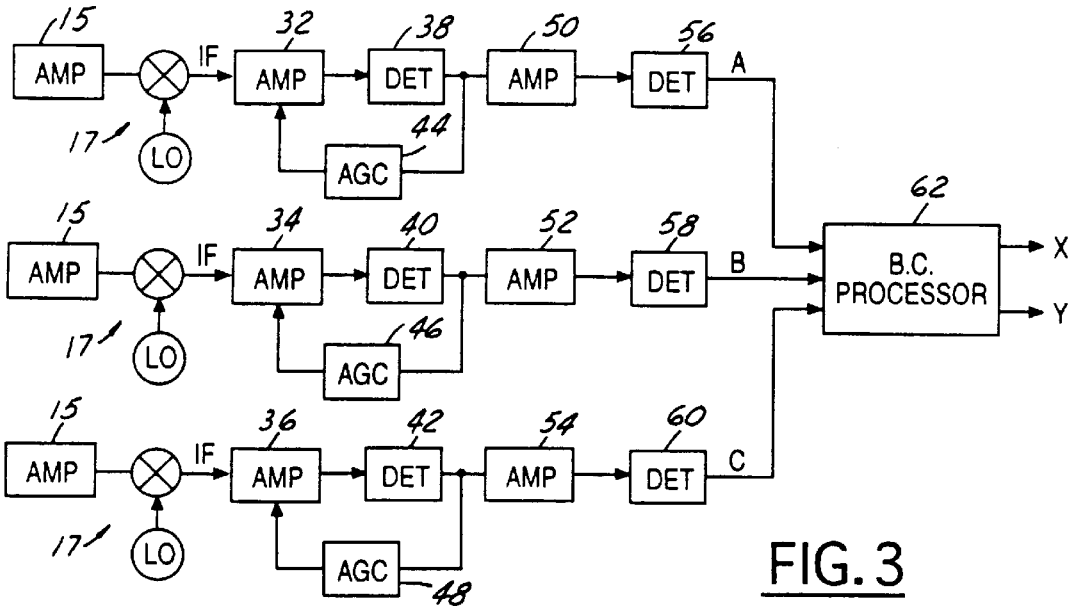
FIG. 3 is a schematic representation of the precision beacon tracking system of the present invention.

Referring to FIG. 3, a block diagram of the beacon tracking system of the present invention is shown. Each horn in the set of horns 14 has a low noise pre-amplifier 15 followed by a down converter 17 where signals are converted to an intermediate frequency IF. The intermediate frequency from each horn in the set of receive horns 14 is used in the communication function for the satellite. However, as discussed above, at least three of the horns 20, 22 and 24 are used additionally for the tracking function.

It is inevitable that variations in the gain and loss for the individual amplifiers, transmission lines, and down-converters will create errors when the powers received by the horns are compared. The result is a non-negligible mispointing of the antenna and/or satellite. The present invention eliminates this source of error by ensuring that each amplifier has the same gain. In the present invention, the reference signal 30 impinges equally on all of the receive horns, by virtue of its broad beam and equal range to the set of horns.

Figure 4:
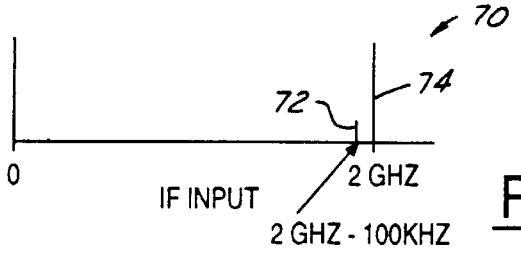
FIG. 4 is a graph of the spectrum at the Intermediate Frequency input consisting of the reference signal and the beacon signal.

The intermediate frequencies (IF) for each of the three horns 20, 22 and 24, are designated by $IF_{20}$, $IF_{22}$, and $IF_{24}$. The intermediate frequencies are input to amplifiers 32, 34, and 36 respectively for automatic gain controlled amplification. A first detector 38, 40, and 42 follows each of the amplifiers 32, 34, and 36 and detects the DC component of the reference signal, which is more powerful than the beacon signal. The frequencies of the beacon signal, which for example purposes only would be approximately 30 GHz, and the reference signal are designed to be approximately 100 kHz apart. The Intermediate Frequency is approximately 2 GHz. FIG. 4 is a graph of the spectrum at the intermediate frequency input 70 showing the reference signal 74 and the beacon signal 72.

Figure 5:
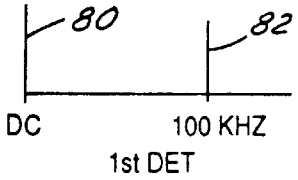
FIG. 5 is graph of the spectrum at the first detector showing the DC component at the automatic gain control and the beat frequency whose power is proportional to the received beacon power.

Feedback from the DC component of the detected signal is used by a gain control unit to adjust the gain of the amplifiers 32, 34, and 36 in order to keep the detected DC signal to a predetermined value, which is the same for all three channels. This ensures that the gain from the feed horns is the same for all three channels. First detectors 38, 40 and 42 also detect the beacon signal as the beat frequency between the reference and beacon signal. FIG. 5 is a graph of the spectrum at the first detector showing the DC component 80 and the beat frequency 82. The beat frequency is chosen low enough to facilitate its amplification in a fixed gain amplifier which is established by precision feedback in order to prevent errors due to differences in gain slope in the three channels from introducing any error.

Figure 6:
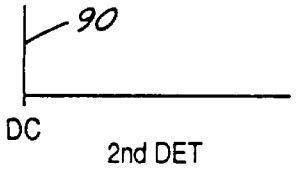
FIG. 6 is a graph of the DC signal at the second detector whose power is proportional to the received beacon power.

The power comparison needed for the error signal derivation proceeds in a straightforward manner. Second amplifiers 50, 52, and 54 follow the automatic gain control loop for each feed horn 20, 22, and 24 for boosting the AC component of the detected signal, or the beat frequency. This component of the signal contains the tracking information. Precision amplifiers are used at this step to maintain the equalized gain achieved by the automatic gain controlled amplifiers. Second detectors 56, 58, and 60 make a DC signal out of the beat frequency which results in three detected outputs designated by A, B, and C in FIG. 3. FIG. 6 shows the DC component 90 at the second detector whose power is proportional to the received beacon power.

The three detected outputs A, B, and C are directed to a processor 62 where they are processed to produce precision error signals for tracking purposes corresponding to x-y coordinates. References X and Y in FIG. 3 represent these signals and are defined as:

$$X=[A-(B+C)/2][A+B+C]^{-1} \quad (1)$$

$$Y=[B-C][A+B+C]^{-1} \quad (2)$$

The present invention utilizes an antenna system, remotely located from a satellite, that generates a beacon signal used to command the satellite. The beacon signal that is used to send command signals to the satellite is further utilized in the present invention to provide error signals for precision tracking. Through the use of a locally generated reference signal that is larger than the beacon signal, the present invention equalizes the gain of at least three amplifiers used for error signal generation, thereby eliminating any errors caused by differences in gains of these amplifiers.

More specifically, the precision tracking system and method of the present invention can reduce pointing error to below 0.01 degree. This precision tracking improves the edge of the beam gain and reduces the interference from nearby beams. The present invention eliminates the sources of pointing error related to uncontrolled differences in passive loss or in amplification of the separate signals used in creating an error signal by ensuring each path has the same gain.

While particular embodiments of the invention have been shown and described, numerous variations and alternate embodiments will occur to those skilled in the art. Accordingly, it is intended that the invention be limited only in terms of the appended claims.

What is claimed is:

1. A precision tracking system for a communication system, said precision tracking system comprising:

an antenna assembly having a set of feed horns and focusing means for receiving a radiated signal from a remote signal source;

a reference signal source centrally located on said focusing means for radiating a reference signal to said set of feed horns;

automatic gain control coupled to at least three horns of said set of feed horns for detecting said reference signal and maintaining equal gain outputs for each of said at least three horns; and a processor coupled to said equal gain outputs for each of said at least three horns, said processor for producing precision tracking signals.

2. The system as claimed in claim 1 wherein said automatic gain control further comprises:

a first amplifier for each of said at least three horns;

a first detector coupled to said first amplifier for each of said at least three horns, said first detector for detecting a dc component of said reference signal, and an ac component corresponding to said radiated signal; and a feedback loop for adjusting the gain of said amplifier for each of said at least three horns based on the value of said dc component of said reference signal.

3. The system as claimed in claim 2 wherein said first detector is followed by a second amplifier for amplifying said ac component of said detected signal for each of said at least three horns and wherein a second detector is coupled to said second amplifier to produce an output signal for each of said at least three horns.

4. The system as claimed in claim 3 wherein said second amplifiers for each of said at least three horns are stable gain amplifiers.

5. The system as claimed in claim 1 wherein said reference signal is on the order of 30 GHz and said signal from said remote source has a separation of approximately 100 kHz from said reference signal.

6. The system as claimed in claim 1 wherein said focusing means is a reflector.

7. The system as claimed in claim 1 wherein said focusing means is a lens.

8. The system as claimed in claim 1 wherein said processor produces a precision tracking signal having X and Y components defined by a mathematical formula in which A, B, and C represent said equal gain outputs for said at least three horns respectively and wherein:

$$X=[A-(B+C)/2][A+B+C]^{-1}$$

$$Y=[B-C][A+B+C\}^{-1}.$$

9. A precision beacon tracking system for a communications satellite, said system comprising:

an antenna assembly located on said communications satellite, said antenna assembly having a reflector illuminated by a set of feed horns, said antenna assembly for receiving a radiated signal from a remote signal source;

a reference signal source centrally located on said reflector for radiating a reference signal to said set of feed horns;

automatic gain control means coupled to at least three horns in said set of feed horns for maintaining equal gain outputs for each of said at least three horns; and processing means coupled to said automatic gain control means for producing precision tracking signals.

10. The system as claimed in claim 9 wherein said reference signal source further comprises a small antenna.

11. The system as claimed in claim 9 wherein said automatic gain control means further comprises a first amplifier for each of said at least three horns;

a first detector coupled to said first amplifier for each of said at least three horns, said first detector for detecting a dc component of said reference signal; and a feedback loop following said first detector and coupled to said first amplifier for each of said at least three horns whereby said feedback loop adjusts the gain of said first amplifier based on the value of said dc component of said reference signal in order to maintain equal gain on each first amplifier.

12. The system as claimed in claim 11 wherein said automatic control means further comprises:

a second amplifier following said feedback loop for each of said at least three horns, said second amplifier for amplifying an ac component of said detected signal; and a second detector coupled to said second amplifier for each of said at least three horns, said second detector for producing an output signal.

13. The system as claimed in claim 12 wherein said second amplifier for each of said at least three horns further comprises a precision amplifier.

14. The system as claimed in claim 1 wherein said processor produces a precision tracking signal having X and Y components defined by a mathematical formula in which A, B, and C represent said equal gain outputs for said at least three horns respectively and wherein:

$$X=[A-(B+C)/2][A+B+C]^{-1}$$

$$Y=[B-C][A+B+C\}^{-1}.$$

15. A method for precision beacon tracking comprising the steps of:

radiating a beacon signal from a remote signal source;

receiving said beacon signal at an antenna system;

focusing said beacon signal onto a set of feed horns;

radiating a reference signal onto said set of feed horns;

equalizing a gain for at least three horns in said set of feed horns whereby at least three outputs having equal gain are produced; and processing said equalized gain outputs to produce precision tracking signals.

16. The method as claimed in claim 15 wherein said step of radiating said reference signal further comprises radiating said reference signal from a small antenna centrally located on a reflector for a communications satellite.

17. The method as claimed in claim 15 wherein said step of equalizing said gain for at least three of said feed horns further comprises the steps of:

amplifying said reference signal and said beacon signals received at a first amplifier;

detecting a dc component of said reference signal;

feeding back said dc component of said reference signal to said first amplifier for automatic gain control of said first amplifier;

amplifying an ac component of said beacon signal in a second amplifier;

detecting a beat frequency between said reference signal and said beacon signal to produce at least three equalized gain output signals received by each of said at least three horns; and wherein said step of processing further comprises processing said equalized gain output signals to produce x-y coordinate precision tracking signals.

18. The method as claimed in claim 17 wherein said x-y coordinate precision tracking signals are defined by a mathematical formula in which A, B, and C represent said equalized gain outputs for said at least three horns respectively and wherein:

$$X=[A-(B+C)/2][A+B+C]^{-1}$$

$$Y=[B-C][A+B+C\}^{-1}.$$

* * * * *